US007047837B2

(12) United States Patent
Hayashihara

(10) Patent No.: US 7,047,837 B2
(45) **Date of Patent: *May 23, 2006**

(54) VEHICLE PEDAL DEVICE WHEREIN NON-OPERATED POSITION OF OPERATING PORTION IS ADJUSTABLE IN LONGITUDINAL DIRECTION OF VEHICLE

(75) Inventor: Takashi Hayashihara, Toyota (JP)

(73) Assignee: Toyoda Iron Works Co., Ltd., Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/872,441

(22) Filed: Jun. 22, 2004

(65) Prior Publication Data

US 2004/0226399 A1 Nov. 18, 2004

Related U.S. Application Data

(63) Continuation of application No. 09/977,204, filed on Oct. 16, 2001, now Pat. No. 6,782,775.

(30) Foreign Application Priority Data

Dec. 22, 2000 (JP) ..... 2000-391310

(51) Int. Cl.
*G05G 1/14* (2006.01)

(52) U.S. Cl. ..... 74/512; 74/513; 74/514; 74/560

(58) Field of Classification Search ..... 74/512, 74/513, 560, 561, 562, 514
See application file for complete search history.

(56) References Cited

U.S. PATENT DOCUMENTS 3,643,524 A 2/1972 Herring ..... 74/512
3,667,314 A 6/1972 Ritter ..... 74/512
3,678,779 A 7/1972 Janosi ..... 74/516
4,005,617 A 2/1977 Sourbel et al. ..... 74/516
4,875,385 A 10/1989 Sitrin ..... 74/512
5,010,782 A 4/1991 Asano et al. ..... 74/512
5,086,663 A 2/1992 Asano et al. ..... 74/512

(Continued)

FOREIGN PATENT DOCUMENTS

EP 1 481 867 A1 * 12/2004 ..... 74/512

(Continued)

OTHER PUBLICATIONS

U.S. Appl. No. 09/977,248, filed Oct. 16, 2001, Hayashihara et al., Toyoda Iron Works Co., Ltd.

*Primary Examiner*—Vinh T. Luong

(57) ABSTRACT

Pedal device mounted on a bracket fixed to a vehicle body, and including a pedal arm having an operating portion, and a position adjusting device to adjust the non-operated position of the operating portion in vehicle longitudinal direction, the position adjusting device includes a first member having a pair of guides, a second member disposed movably relative to the first member in a substantially vertical plane substantially parallel to the longitudinal direction, and having a pair of guide pieces are movable in engagement with the respective, and a positioning device to establish a desired relative position between the first and second members, by moving the guides and the guide pieces relative to each other, wherein one of the first and second members has the operating portion and is movable relative to the other to move the operating position, and the guides are formed such that an attitude of the operating portion changes as the operating portion is moved in the vehicle longitudinal direction.

9 Claims, 7 Drawing Sheets

U.S. PATENT DOCUMENTS

| | | | | |
|---|---|---|---|---|
| 5,460,061 | A | 10/1995 | Redding et al. | 74/512 |
| 5,890,399 | A | 4/1999 | Rixon et al. | |
| 5,964,125 | A | 10/1999 | Rixon et al. | |
| 5,970,817 | A * | 10/1999 | Ichiba | 74/512 |
| 5,996,438 | A | 12/1999 | Elton | 74/512 |
| 5,996,439 | A | 12/1999 | Elton et al. | 74/512 |
| 6,178,847 | B1 | 1/2001 | Willemsen et al. | 74/512 |
| 6,289,761 | B1 | 9/2001 | Reynolds et al. | |
| 6,324,939 | B1 | 12/2001 | Cicotte | 74/512 |
| 6,367,348 | B1 | 4/2002 | Toelke et al. | 74/512 |
| 6,367,349 | B1 | 4/2002 | Allen et al. | 74/512 |
| 6,571,660 | B1 * | 6/2003 | Gmurowski et al. | 74/512 |
| 6,584,871 | B1 * | 7/2003 | Burton et al. | 74/512 |
| RE38,327 | E | 11/2003 | Sakamoto et al. | |
| 6,782,776 | B1 * | 8/2004 | Oberheide et al. | 74/512 |
| 6,918,318 | B1 * | 7/2005 | Willemsen | 74/560 |
| 2002/0002874 | A1 | 1/2002 | Burton et al. | 74/512 |
| 2002/0088303 | A1 * | 7/2002 | Hayashihara et al. | 74/560 |
| 2002/0148322 | A1 | 10/2002 | Gmurowski et al. | 74/512 |
| 2002/0166408 | A1 | 11/2002 | Willemsen | 74/560 |
| 2003/0106392 | A1 * | 6/2003 | Willemsen | 74/512 |
| 2005/0039563 | A1 * | 2/2005 | Arakawa et al. | 74/512 |

FOREIGN PATENT DOCUMENTS

| | | | | |
|---|---|---|---|---|
| FR | 2739947 | 4/1997 | | 74/512 |
| JP | 51-22218 | 2/1976 | | |
| JP | 63-3412 | 1/1988 | | |
| JP | 63-4313 | 1/1988 | | |
| JP | 2-39807 | 9/1990 | | |
| JP | 5-185912 | * 7/1993 | | 74/512 |
| JP | 5-37295 | 9/1993 | | |
| JP | 6-40292 | 5/1994 | | |
| JP | 7-191773 | 7/1995 | | |
| JP | 7-205776 | 8/1995 | | |
| WO | WO 02/19051 | 3/2002 | | 74/512 |

* cited by examiner

VEHICLE PEDAL DEVICE WHEREIN NON-OPERATED POSITION OF OPERATING PORTION IS ADJUSTABLE IN LONGITUDINAL DIRECTION OF VEHICLE

CROSS-REFERENCE TO RELATED APPLICATIONS

This application is a continuation application of application Ser. No. 09/977,204, filed Oct. 16, 2001 now U.S. Pat. No. 6,782,775, and now allowed.

This application is based upon and claims the priority of Japanese application no. 2000-391310, filed Dec. 22, 2000, and U.S. patent application Ser. No. 09/977,204, filed Oct. 16, 2001, the contents being incorporated herein by reference.

BACKGROUND OF THE INVENTION

1. Field of the Invention

The present invention relates in general to a pedal device provided on an automotive vehicle, such as a brake pedal device and an accelerator pedal, and more particularly to an improved vehicle pedal device wherein the position of an operating portion of a pedal arm in its non-operated state is movable in the longitudinal or running direction of the vehicle.

2. Discussion of Related Art

There is widely known a pedal device for an automotive vehicle, such as a brake pedal device and an accelerator pedal device. Such a pedal device includes a pedal arm which is pivotally supported by a stationary bracket fixed on the vehicle and which has an operating portion in the form of a pedal pad, for instance, at its lower end, so that the pedal arm is operated at its operating portion. The pedal device is arranged to push or pull a desired power transmitting member, or to convert its operating stroke or force into an electric signal. One type of the pedal device which has been proposed is adapted such that the operating portion of the pedal arm in its non-operated state is movable in the longitudinal or running direction of the vehicle. Examples of the pedal of the type indicated above are disclosed in JP-B2-6-40292 (first prior art pedal device) and JP-B2-2-39807 (second prior art pedal device). These pedal devices are easily operable by an operator of the vehicle, irrespective of the specific physical characteristics of the operator, since the non-operated position of the operating portion of the pedal arm is adjustable in the longitudinal direction of the vehicle relative to the vehicle operator.

In the first prior art pedal device indicated above, the pedal arm including the operating portion is movable through a pair of parallel straight elongate holes along a straight line, with its attitude kept constant. In the second prior art pedal device, the pedal arm including the operating portion is movable through an arcuate elongate hole along a circular arc.

However, the first prior art pedal device adapted to translate the pedal arm while keeping its attitude does not necessarily permit the vehicle operators with their legs having different lengths to manipulate the pedal arm with a sufficiently high degree of operational ease. Described in detail, when the pedal arm is placed at its non-operated position or the rearmost position nearest to the operator's seat in the longitudinal direction of the vehicle, the operator's foot generally approaches the operating portion of the pedal arm in an almost vertical direction, to press down the operating portion. If the attitude of the operating portion of the pedal arm is designed to have an operating surface which faces comparatively upwards when the pedal arm is placed at its non-operated position, the pedal arm cannot be necessarily manipulated by the foot with a sufficiently high degree of operational ease at its operating surface facing comparatively upwards, when the pedal arm has been considerably operated in the forward direction toward its fully operated position. Conversely, if the attitude of the operating portion of the pedal arm is designed to have an operating surface which faces comparatively rearwards when the pedal arm is placed at its fully operated position, the pedal arm cannot be depressed with ease when the pedal arm is placed at its non-operated position.

In the second prior art pedal device, the operating portion of the pedal arm is located at a comparatively low position when the pedal arm is placed at its non-operated position nearest to the vehicle operator's seat. Further, the operating surface of the operating portion faces comparatively upwards when the pedal arm is placed at its non-operated position. Accordingly, the pedal arm can be manipulated with a high degree of operational ease, irrespective of the adjusted position of the operating portion of the pedal arm in the non-operated state (at the non-operated position). However, the second prior art pedal device suffers from a relatively high cost of manufacture due to difficult formation of the arcuate elongate hole for guiding the pedal arm, and the use of an expensive arcuate rack for arcuate movement of the pedal arm.

SUMMARY OF THE INVENTION

It is therefore an object of the present invention to provide a pedal device which is easy and economical to manufacture and which permits changes in the level and attitude of the operating portion of the pedal arm as desired, depending upon the adjusted position of the operating portion of the pedal arm in its non-operated state in the longitudinal direction of the vehicle.

The above object may be achieved according to any one of the following modes of this invention:

(1) A pedal device mounted on a bracket fixed to a body of an automotive vehicle, and including a pedal arm having an operating portion at a lower end thereof, and a position adjusting device operable to adjust a position of the operating portion in a longitudinal direction of the automotive vehicle when the pedal arm is placed in a non-operated state thereof, the position adjusting device comprising:

a first member having a pair of guides;

a second member disposed movably relative to the first member in a substantially vertical plane substantially parallel to the longitudinal direction, and having a pair of guide pieces which are movable in engagement with the pair of guides, respectively; and a positioning device operable to establish a desired relative position between the first and second members, by moving the pair of guides and the pair of guide pieces relative to each other, the positioning device permitting the first and second members permitting the first and second members to maintain the desired relative position after the desired relative position is established, wherein one of the first and second members has the operating portion and is movable relative to the other of the first and second members, to move the operating position in the longitudinal direction, and wherein the pair of guides are formed such that an attitude of the operating portion changes as the operating portion is moved in the longitudinal direction.

In the pedal device constructed according to the above mode (1) of this invention, the first and second members are connected and movable relative to each other through engagement of the pair of guides and the pair of guide pieces, to move the operating portion of the pedal arm in the longitudinal direction of the vehicle, while the pedal arm is placed in its non-operated state. Further the pair of guides are formed to change the attitude of the operating portion as the operating portion is moved in the longitudinal direction. For instance, the operating surface of the operating portion of the pedal arm is gradually inclined upwards as the non-operated position of the operating portion is moved in the rearward direction of the vehicle toward the seat of the vehicle operator. This arrangement permits the pedal arm to be operated with a high degree of operational ease at the suitably inclined operating surface of the operating portion, irrespective of the non-operated position of the operating portion in the longitudinal direction of the vehicle.

Further, the present pedal device is arranged such that the attitude of the operating portion of the pedal arm is changed with a change in the longitudinal position of the operating portion of the pedal arm in the non-operated state, by a simple mechanism which has the pair of guides and the pair of guide pieces engaging. For example, the pair of guides are straight guides which intersect each other. Accordingly, the pedal device is simple in construction and economical to manufacture. In addition, the guides can be formed at desired positions, so as to reduce the size of the pedal device, while assuring a required degree of strength at the connection of the first and second members.

(2) A pedal device according to the above mode (1), wherein the pair of guides consist of a pair of straight guides which are positioned such that extension lines of said straight guides intersect each other such that the attitude of the operating portion changes as the operating portion is moved in the longitudinal direction as a result of a relative movement of the first and second members with the pair of guide pieces being moved in engagement with the pair of straight guides, respectively.

In the pedal device constructed according to the above mode (2) of the present invention, the first and second members are moved relative to each other through engagement of the pair of straight guides and the pair of guide pieces, to move the non-operated position of the operating portion of the pedal arm in the longitudinal direction of the vehicle. Further, the arrangement of the straight guides such that the extension lines of these straight guides intersect each other permits a change of the attitude of the operating portion as the operating portion is moved in the longitudinal direction of the vehicle. For example, the straight guides are positioned such that the operating surface of the operating portion is gradually inclined upwards as the operating portion is moved in the rearward direction of the vehicle toward the seat of the vehicle operator, so that the pedal arm can be operated with a high degree of operational ease at the suitably inclined operating surface of the operating portion, irrespective of the non-operated position of the operating portion in the longitudinal direction of the vehicle.

Further, the attitude of the operating portion of the pedal arm can be changed with a change in the longitudinal position of the operating portion, by a simple mechanism including the pair of straight guides and the pair of guide pieces engaging the respective straight guides. The straight guides and the guide pieces can be easily formed or manufactured. Accordingly, the present pedal device according to the above mode (2) is simpler in construction and available at a lower cost of manufacture, than the known pedal device using an arcuate hole and an arcuate rack. In addition, the straight guides can be formed at desired positions, so as to reduce the size of the pedal device, while assuring a required degree of strength at the connection of the first and second members.

(3) A pedal device according to the above mode (2), wherein the pair of straight guides are positioned such that a vertical position of the operating portion is lowered while an operating surface of the operating portion is gradually inclined upwards as the operating portion is moved in a rearward direction of the vehicle toward a seat of an operator of the vehicle.

In the pedal device according to the above mode (3), the vertical position of the operating portion of the pedal arm is lowered and the operating surface of the operating portion is gradually inclined upwards as the operating portion is moved in the rearward direction of the vehicle toward the seat of the vehicle operator, so that the pedal arm can be easily operated. There is a general tendency that the operating portion of the pedal arm in its non-operated state is positioned comparatively near the operator's seat where the operator has relatively short legs and feet, and comparatively distant from the operator's seat where the operator has relatively long legs and feet. In view of this tendency, the vertical position of the operating portion is lowered as the operating portion is moved in the rearward direction, so that the operating portion can be relatively easily operated by an operators who are either tall or short.

(4) A pedal device according to the above mode (2) or (3), wherein the second member has the operating portion and is movable relative to the first member, and the positioning device comprises a relative-movement device including a feedscrew disposed on the first member such that such that the feedscrew is parallel to one of the pair of straight guides and rotatable about an axis thereof, and an internally threaded member connected to one of the guide pieces which engages the above-indicated one of the pair of straight guides, the internally threaded member being held in engagement with the feedscrew and pivotable relative to the second member about an axis perpendicular to the above-indicated substantially vertical plane, and wherein the relative-movement device is operable to rotate the feedscrew to move the second member relative to the first member and maintain the desired relative position between the first and second members after a rotary motion of the feedscrew is terminated.

In the pedal device according to the above mode (4) wherein the guide pieces are disposed on the second member which has the operating portion and which is moved relative to the first member to move the operating portion in the longitudinal direction, the required size of the second member can be made smaller than in an arrangement wherein the first member having the straight guides is moved relative to the second member. Accordingly, the required space for installation of the pedal device on the vehicle can be reduced. In addition, the position of the operating portion of the pedal arm in its non-operated state can be easily and rapidly adjusted in the longitudinal direction of the vehicle, owing to a unique arrangement of the relative-movement device which includes the feedscrew disposed on the fist member in parallel to one of the straight guides, and the internally threaded member connected to the guide piece engaging the above-indicated one straight guide, such that a rotary movement of the feedscrew causes a linear movement of the above-indicated guide piece and a consequent movement of the second member relative to the first member, and such that the termination of the rotary movement of the feedscrew results in the positioning of the second member relative to the first member, and the consequent adjustment of the position of the operating portion of the pedal arm. Furthermore, since the feedscrew is disposed on the first member such that the feedscrew is not axially movable relative to the first member, the relative-movement device can be made simple in construction and is available at a relatively low cost (5) A pedal device according to any one of the above modes (1)–(4), wherein the pedal arm includes the first and second members, and the above-indicated other of the first and second members which does not have the operating portion is a pivotal arm which is disposed pivotally about a support shaft supported by the bracket, the pedal arm being pivoted about the support shaft when the pedal arm is operated at the operating portion.

In the pedal device according to the above mode (5), the pedal arm is pivoted about the support shaft supported on the bracket fixed to the vehicle body, when the pedal arm is operated at the operating portion. This arrangement assures a relatively high mechanical strength of the pedal device, permitting the pedal device to be suitably used as a brake pedal device or other pedal device which is subjected to a comparatively large operating force.

(6) A pedal device according to the above mode (5), wherein the pivotal arm is operatively connected to a power transmitting member such that an operating force acting on the operating portion of the pedal arm s transmitted to the power transmitting member, the pedal device further including a lever-ratio changing mechanism interconnected between the pivotal arm and the power transmitting member, the lever-ratio changing mechanism being operable to change a lever ratio of the pedal device with a change in an operating amount of said pedal arm.

The lever ratio indicated above is a ratio at which the operating force acting on the operating portion of the pedal arm is boosted into a force by which the power transmitting member is operated, or a ratio of the operating stroke or amount of the pedal arm to that of the power transmitting member.

In the pedal device according to the above mode (6), the lever-ratio changing mechanism is interconnected between the pivotal arm and the power transmitting member, for changing the lever ratio of the pedal device. By suitably designing the lever-ratio changing mechanism, the lever ratio corresponding to a given operating amount or stroke of the pedal can be determined as desired, and the lever ratio can be changed with the operating amount or stroke of the pedal arm in a desired pattern or relationship. Thus, the provision of the lever-ratio changing mechanism together with the position adjusting device further improves the maneuverability of the pedal arm or pedal device.

(7) A pedal device according to the above mode (6), wherein the bracket has a mounting shaft parallel to the support shaft, and the lever-ratio changing mechanism includes (a) a lever member disposed on the bracket pivotally about the mounting shaft and connected to the power transmitting member pivotally about a first connecting shaft parallel to the mounting shaft, and (b) a connecting link connected at one of opposite ends to the lever member pivotally about a second connecting shaft parallel to the mounting shaft, and at the other end to the pivotal arm pivotally about a third connecting shaft parallel to the second connecting shaft, and wherein the operating force is transmitted from the pedal arm to the power transmitting member through the pivotal arm, the connecting link and the lever member.

In the pedal device according to the above mode (7), the lever-ratio changing mechanism includes the connecting link and the lever member which are interposed between the pivotal arm and the power transmitting member, so that the operating force of the pedal arm is transmitted to the power transmitting member through the pivotal arm, the connecting link and the lever member. By suitably determining the configuration or attitude of the lever member and the positions of connection of the lever member to the connecting link and the power transmitting member, the pattern of change of the lever ratio with a change in the operating amount or stroke of the pedal arm (operating portion) can be suitably determined.

(8) A pedal device according to any one of the above modes (1)–(4), wherein the one of the first and second members which has the operating portion includes an adjusting plate operatively connected to the other of the first and second members through the positioning device, and the pedal arm which is connected to the adjusting plate pivotally about a support shaft supported on the adjusting plate, the pedal arm having the operating portion at a lower end portion thereof, and wherein the other of the first and second members consists of the bracket fixed to the body of the vehicle.

In the pedal device according to the above mode (8), the support shaft is provided on the adjusting plate which is moved when the position of the operating portion of the pedal arm in its non-operated state is adjusted in the longitudinal direction of the vehicle. The pedal arm is connected to the adjusting plate pivotally about the support shaft, and has the operating portion at its lower end portion. In this pedal device, the pedal arm is pivoted about the support shaft when the pedal arm is operated at its operating portion. The present arrangement is suitably employed where the pedal device is used as an accelerator pedal device or other pedal device which is not required to be operated with a large operating force.

(9) A pedal device according to the above mode (8), wherein the pedal arm is an accelerator pedal arm, the pedal device further including a sensor operable to convert an operating amount of the accelerator pedal arm into an electric signal.

The pedal device according to the above mode (9) is used as an accelerator pedal device including an accelerator pedal arm the operating amount of which is converted by a suitable sensor into an electric signal. The present accelerator pedal device is simpler in construction than an accelerator pedal device wherein the accelerator pedal arm is mechanically connected to an accelerator cable (provided as a power transmitting member to control an actuator for a throttle valve, for instance).

The pedal device constructed according to the principle of this invention can serve as any pedal device provided on an automotive vehicle, such as a brake pedal device, an accelerator pedal device, a clutch pedal device and a parking brake pedal device. For instance, the pedal device is arranged to push a rod of a brake booster or pull an accelerator cable or a parking brake cable, when the pedal arm is operated. Thus, the operating force or stroke of the pedal arm is mechanically outputted through a rod, cable or any other suitable power transmitting member. Alternatively, the operating force or stroke of the pedal arm of the pedal device may be converted by a suitable sensor into an electric signal. The sensor may be arranged to detect an angle of a pivotal motion or a torque of the pivotal arm provided in the pedal device according to the mode (5) of the invention described above. Alternatively, the sensor may be arranged to detect a load or an amount of movement of the power transmitting member indicated above.

The pair of guides provided on the first member is preferably a pair of straight guides, as in the pedal device according to the above mode (2). However, the guides need not be formed straight. The straight guides are preferably straight elongate holes, but may be straight guide rails or rods. The guide pieces provided on the second member may be bearing members which engage straight guides such as straight elongate holes, guide rails and guide rods, with a suitable attitude relative to the straight guides, such that the bearing members are linearly movable relative to the first member. If necessary, the guide pieces are pivotally supported by the second member.

The straight guides are formed such that extension lines of these straight guides intersect each other. The straight guides need not be continuous with each other in the form of an L-shape, but may be separate from each other, provided the extension lines of the straight guides intersect each other. The straight guides need not line in the same plane.

The positioning device preferably comprises a relative-movement device operable to move the first and second members relative to each other and maintain a desired relative position between the first and second members, as in the pedal device according to the above mode (4). However, the positioning device may be removable fastening means such as bolts and nuts for fixing the first and second members together with a desired relative position therebetween after the first and second members are moved to establish the desired relative position through engagement of the straight guides and the guide pieces.

In the pedal device according to the above mode (3), the straight guides are positioned such that the vertical position of the operating portion of the pedal arm is lowered while the operating surface of the operating portion is gradually inclined upwards, as the operating portion is moved in the rearward direction of the vehicle toward the vehicle operator's seat. In the pedal device according to the above mode (1) or (2), however, the guides may be positioned such that the vertical position of the operating portion of the pedal arm is held substantially constant irrespective of a change in the position of the operating portion of the pedal arm in the non-operated state in the longitudinal direction of the vehicle, or such that the vertical position of the operating portion is raised as the position of the operating portion is moved in the rearward direction of the vehicle.

In the pedal device according to the above mode (4), the second member has the operating portion and is moved relative to the first member when the position of the operating portion is adjusted in the longitudinal direction of the vehicle. However, the pedal device according to the other modes may be arranged such that the first member has the operating portion and is moved relative to the second member upon adjustment of the longitudinal position of the operating portion.

In the pedal device according to the above mode (4), the relative-movement device includes a feedscrew and an internally threaded member. In the pedal device according to the other modes of the invention, any other type of relative-movement device for a relative linear movement of the first and second members may be used. For instance, a linear-movement mechanism including a rack and a pinion may be used. Further, the relative-movement device may be arranged such that the feedscrew is disposed on the second member pivotally about an axis perpendicular to the above-indicated substantially vertical plane, while the internally threaded member is disposed on the second member pivotally about an axis perpendicular to the substantially vertical plane. The relative-movement device may be arranged such that the feedscrew is manually rotated to move the first and second members relative to each other, or such that the feedscrew is rotated by power-operated drive means such as an electric motor to move the first and second members relative to each other, by turning on a suitable switch provided to control the power-operated drive means.

In the pedal device according to the above mode (5), the pedal arm consists of the first and second members of the position adjusting device, for example. In this case, one of the first and second members is the pivotal arm while the other has the operating portion. The pivotal arm may be an upper member while the other member may be a lower member having the operating portion. In the arrangement according to the above mode (5), the pivotal arm constitutes a part of the pedal arm. In an alternative arrangement, neither the first member nor the second member of the position adjusting device constitutes a part of the pedal arm having the operating portion. In this alternative arrangement, the pedal arm is a pivotal arm pivotally connected to the position adjusting device. Thus, a pivotal arm may constitute a part of the pedal arm or the entirety of the pedal arm.

The lever-ratio changing mechanism provided in the pedal device according to the above mode (6) may include a lever member and a connecting link as provided in the pedal device according to the above mode (7). However, the lever-ratio changing mechanism may use any other arrangement shaft, and the lever-ratio changing mechanism includes (a) a lever member disposed on the bracket pivotally about a mounting shaft and connected to the power transmitting member pivotally about a connecting shaft parallel to the mounting shaft, and (b) an engaging mechanism connected between the lever member and the pivotal arm, for pivoting the lever member when the pivotal arm is pivoted. The engaging mechanism may use an elongate hole and a piece engaging the elongate hole, or a cam mechanism. While the lever member and the power transmitting member are connected to each other pivotally about the first connecting shaft in the pedal device according to the above mode (7), the lever member and the power transmitting member may be connected to each other through a connecting link as used for connecting the pivotal arm to the lever member.

Although the pedal device according to the above mode (9) is used as an accelerator pedal device, the pedal device according to the above mode (8) may be used as a brake pedal device, a clutch pedal device and any other pedal device, which preferably includes a sensor arranged to convert the operating amount of the pedal arm into an electric signal used for controlling a brake or a clutch.

BRIEF DESCRIPTION OF THE INVENTION

The above and other objects, features, advantages and technical and industrial significance of the present invention will be better understood by reading the following detailed description of a presently preferred embodiment of the invention, when considered in connection with the accompanying drawings, in which.

Figure 6:
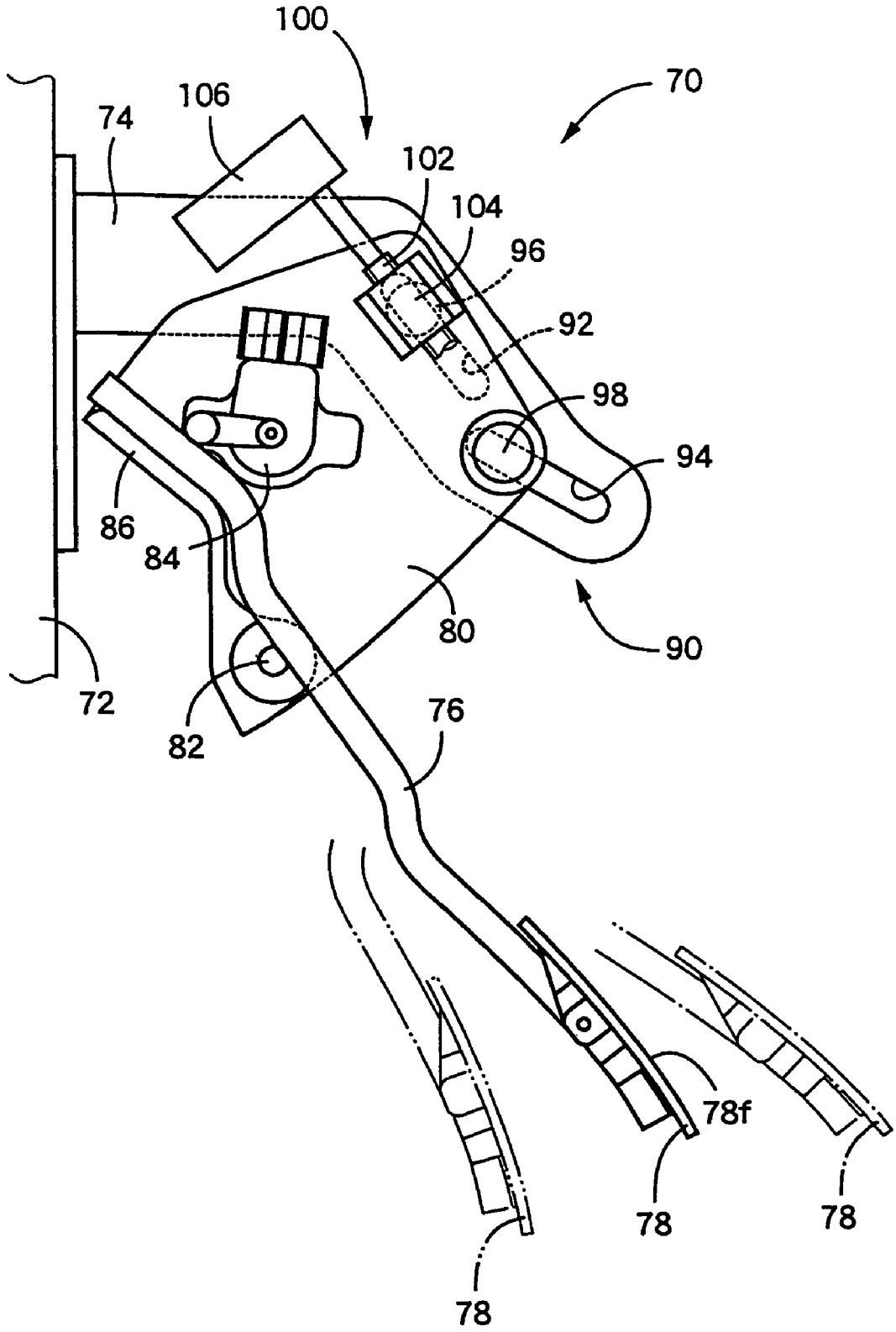
Figure 7:
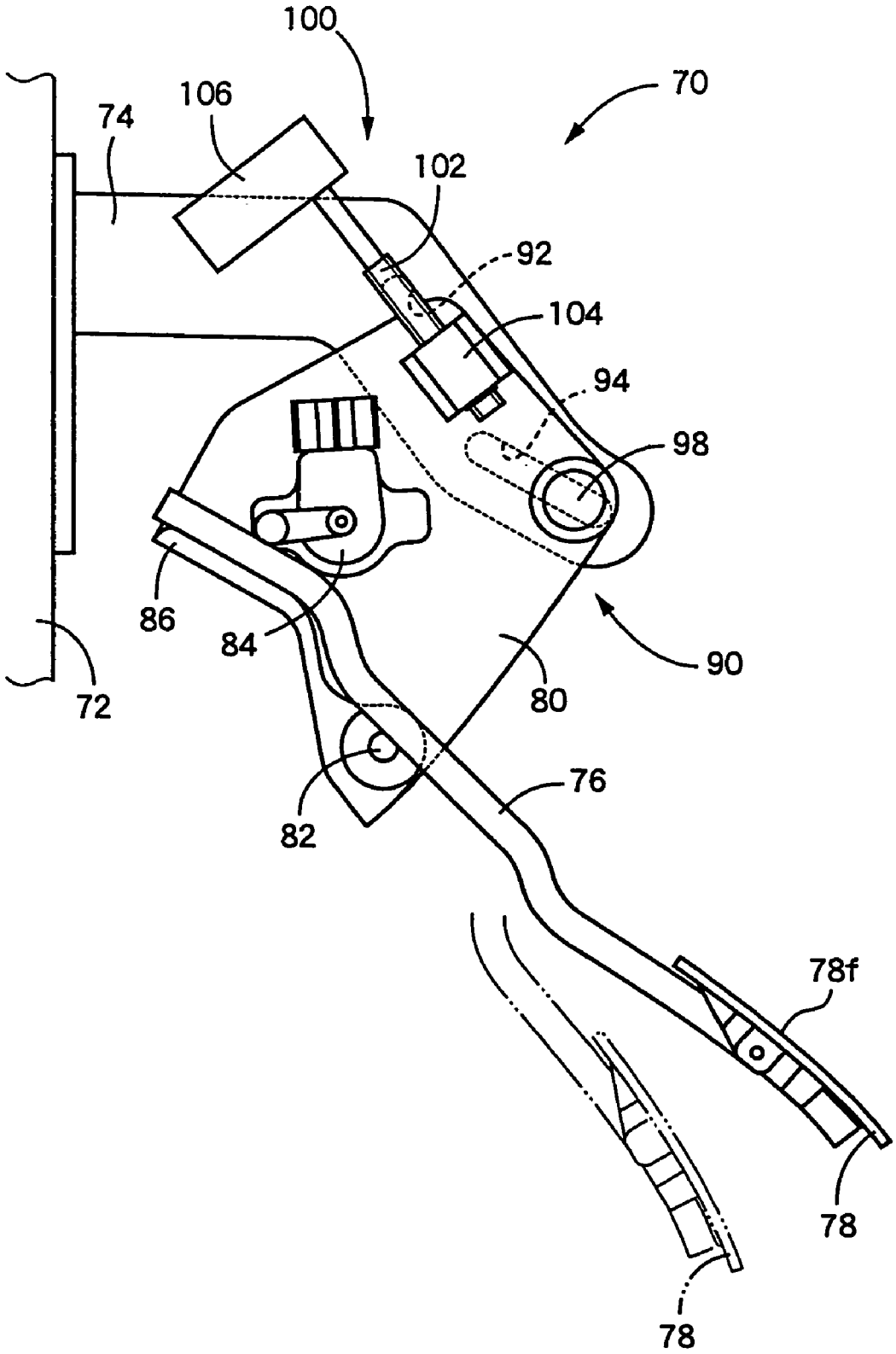

FIG. 6 is a front elevational view showing a pedal device according to a third embodiment of this invention, in the form of an accelerator pedal device for an automotive vehicle, when a pedal operating portion of the accelerator pedal device in its non-operated state is located at its fully advanced position; and FIG. 7 is a view showing the accelerator pedal device when its pedal operating portion in the non-operated state is located at the fully retracted position.

DETAILED DESCRIPTION OF THE PREFERRED EMBODIMENTS

Figure 1:
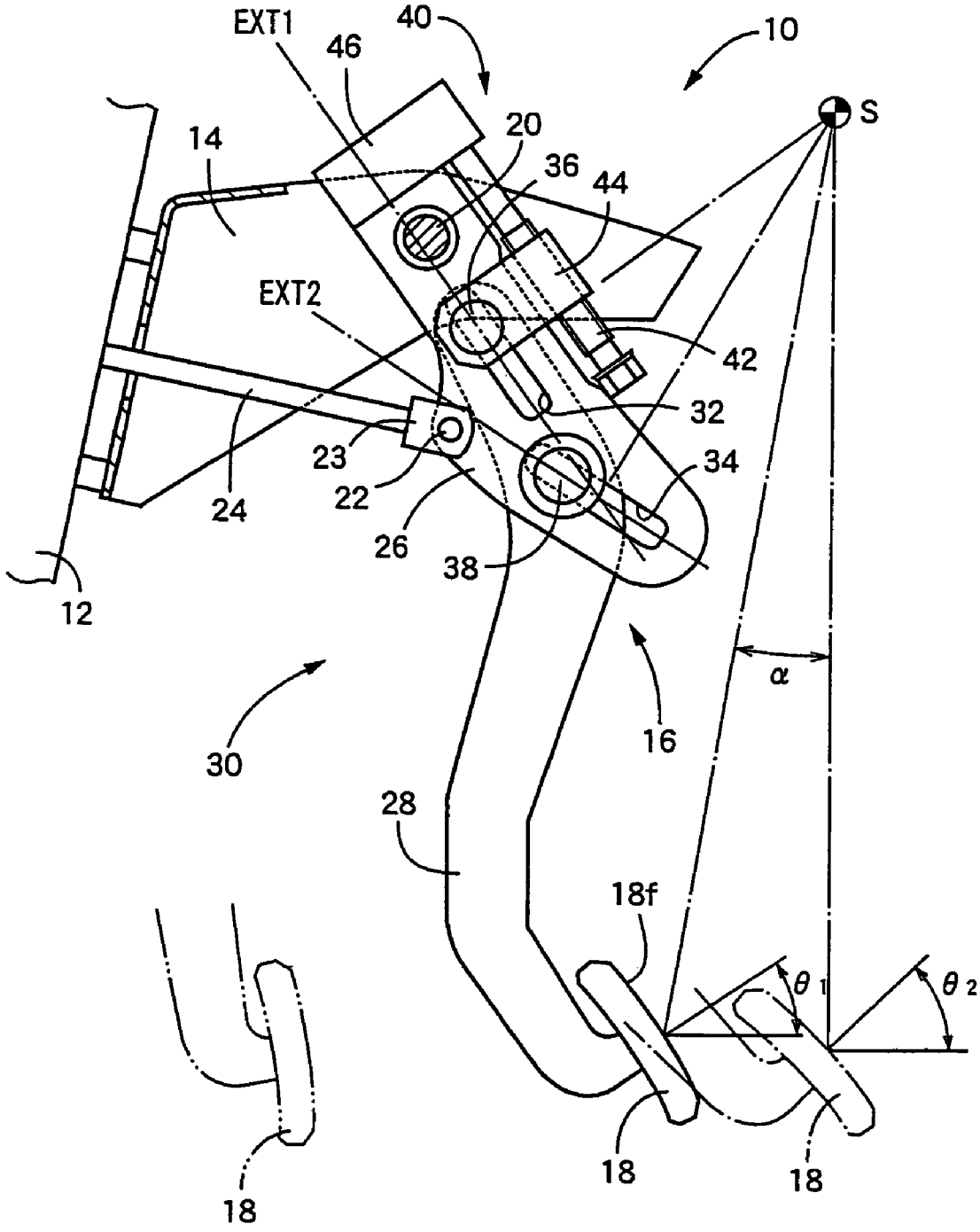
FIG. 1 is a partly cut-away front elevational view showing a pedal device according to one embodiment of this invention, in the form of a brake pedal device for an automotive vehicle, when a pedal operating portion of the brake pedal device in the non-operated state is located at the fully advanced position.

Referring to first to the partly cut-away front elevational view of FIG. 1, there is shown a pedal device for an automotive vehicle, in the form of a brake pedal device 10 constructed according to one embodiment of this invention. The brake pedal device 10 as shown in FIG. 1 is installed in place on the vehicle. In FIG. 1, the left portion of the view corresponds to the front side of the vehicle, while the right side portion corresponds to the rear side of the vehicle. Namely, a vehicle operator's seat is located on the right side of the elevational view of FIG. 1. The brake pedal device 10 is mounted on a bracket 14 fixed on a body or frame 12 of the vehicle, and includes a pedal arm 16 having an operating portion in the form of a pedal pad 18 at its lower end. When the pedal arm 16 is depressed at its pedal pad 18 while the pedal arm 16 is placed at its non-operated or original position indicated by solid line in FIG. 1, the pedal arm 16 is pivoted about a support shaft 20 supported by the bracket 14, so as to push a rod 24 of a brake booster (not shown), which is connected to the pedal arm 16 through a connecting shaft 22 and a clevis 23. The connecting shaft 22 is parallel to the support shaft 20. An advancing movement of the rod 24 of the brake booster by the pivotal movement of the pedal arm 16 causes an advancing movement of a piston rod of a hydraulically operated master cylinder so that the master cylinder delivers a pressurized fluid for operating a hydraulically operated brake for braking the automotive vehicle. It will be understood that the booster rod 24 functions as a motion or power transmitting member. It is noted that the support shaft 20 is attached to the bracket 14 such that the axis of the support shaft 20 extends substantially horizontally in a direction substantially parallel to the transverse or lateral direction of the vehicle.

The pedal arm 16 consists of an upper member in the form of a pivotal arm 26 supported by the support shaft 20 pivotally about this support shaft 20, and a lower arm 28 having the integrally formed pedal pad 18. The pivotal arm 26 is connected to the booster rod 24, and the pivotal arm 26 and the lower arm 28 are pivoted about the support shaft 20, normally as a unit. While the pedal arm 16 is at rest, it is held in its predetermined non-operated position indicated by solid lines in FIGS. 1 and 2, with the pivotal arm 26 being biased by the rod 24 in the counterclockwise direction about the support shaft 20 as viewed in FIGS. 1 and 2. When the pedal arm 16 is operated at its pad 18, it is pivoted in the clockwise direction about the support shaft 20 from the non-operated position to an operated position indicated by two-dot chain lines in FIGS. 1 and 2. When the pedal arm 16 is placed in the non-operated position, the brake pedal device 10 is placed in its non-operated or original position. The non-operated position of the pedal arm 16 (the position of the pivotal arm 26 in the non-operated position of the pedal arm 16) may be determined either by a distance of extension of the rod 24 from the brake booster, or by a suitable stop disposed on the bracket 14.

The pivotal arm 26 and the lower arm 28 are substantially planar members in the form of suitably shaped plates having a relatively small thickness. These two arms 26, 28 are held in surface contact with each other such that the two arms 26, 28 are mutually slidably movable relative to each other in a plane substantially perpendicular to the axis of the support shaft 20, in other words, in a substantially vertical plane substantially parallel to the longitudinal or running direction of the vehicle. The relative position between the pivotal arm 26 and the lower arm 28 when the pedal arm 16 is placed at its non-operated position can be changed by pivoting the lower arm 28 relative to the pivotal arm 26, so that the position of the pad 18 can be moved or adjusted in the longitudinal direction of the vehicle. It will be understood that the pivotal arm 26 and the lower arm 28 cooperate with a relative-movement device 40 (which will be described) to constitute a major portion of a position adjusting device 30 for adjusting or moving the position of the pad 18 of the pedal arm 16 in the non-operated state, in the longitudinal direction of the vehicle, between a fully advanced position (remotest from the operator's seat) indicated by solid line in FIG. 1 and a fully retracted or rearmost position (nearest to the operator's seat) indicated by solid line in FIG. 2. In FIG. 1, the pad 18 at the fully retracted position is indicated by one-dot chain line, for easy comparison of the position and attitude at the fully retracted position with those at the fully advanced position indicated by the solid line. As indicated above, the operated position of the pedal arm 16 (of the pad 18) is indicated by two-dot chain lines in FIGS. 1 and 2.

The pivotal arm 26 has a pair of straight guides in the form of a pair of straight elongate holes 32, 34 formed therethrough, while the lower arm 28 has a pair of guide pieces 36, 38 fixedly provided thereon so as to be linearly movable in engagement with the respective elongate holes 32, 34. The position adjusting device 30 indicated above includes these elongate holes 32, 34 and guide pieces 36, 38, as well as the relative-movement device 40 indicated above. The relative-movement device 40 is arranged to linearly move the guide piece 36 in the longitudinal direction of the elongate hole 32, while being guided by the elongate hole 32, so that at the same time the other guide piece 38 is linearly moved while being guided by the other elongate hole 34, whereby the lower arm 28 is moved relative to the pivotal arm 26, so as to move the pad 18 in the longitudinal direction of the vehicle. The two elongate holes 32,34 are positioned and oriented such that extension lines EXT1 and EXT2 of the elongate holes 32, 34 in their longitudinal direction intersect each other, as shown in FIG. 1, and so that the position of the pad 18 is gradually lowered while an operating surface 18*f* of the pad 18 is gradually inclined upwards (rotated in the counterclockwise direction as seen in FIG. 1) as the pad 18 is moved toward the fully retracted or rearmost position (indicated by the one-dot chain line in FIG. 1). In FIG. 1, "S" represents a point of intersection of two straight lines which pass the midpoints of the lengths of the respective elongate holes 32, 34 and which are perpendicular to the longitudinal direction of the elongate holes 32, 34. At the fully advanced and retracted positions, the pad 18 has two different attitudes which would be taken if the lower arm 28 were pivoted with the pad 18, about the intersection point S. The position adjusting device 30 is adapted such that the fully retracted position of the pad 18 is substantially right under the intersection point S, as indicated in FIG. 1, and such that angles θ1 and θ2 of inclination of the operating surface 18*f* at the fully advanced and retracted positions with respect to the horizontal plane (substantially parallel to the vehicle floor) and an angle a formed by the intersection point S and two straight lines connecting the point S and the centers of the operating surface 18*f* at the fully advanced and retracted positions, satisfy an equation $\theta 1+\alpha=\theta 2$. Thus, the operating surface 18*f* at the fly retracted position of the pedal arm 16 is inclined so as to face more upwards by the angle α, than that at the fully advanced position. It will be understood that the pivotal arm 26 and the lower arm 28 of the pedal arm 16 respectively serve as a first member and a second member of the position adjusting device 30. It is noted that since the lower arm 28 is not actually pivoted about the intersection point S, the pad 18 at a position between the fully advanced and retracted positions does not have an attitude which would be taken if the lower arm 28 were pivoted about the intersection point S.

The relative-movement device 40 includes a feedscrew 42, an internally threaded member 44, and an electrically operated rotary drive device 46. The feedscrew 42 is disposed on the pivotal arm 26 such that the feedscrew 42 extends in parallel with the elongate hole 32 and is ratable about its axis. The internally threaded member 44 is connected to the guide piece 36 engaging the elongate hole 32, and is held in meshing engagement with the feedscrew 42. The rotary drive device 46 includes an electric motor and gears operatively connected to the feedscrew 42. The electric motor is operated to rotate the feedscrew 42 in a selected one of the opposite directions, upon operation of a suitable switch by the vehicle operator. The internally threaded member 44 is connected to the guide piece 46 such that the member 44 is pivotable about an axis of the guide piece 46 which is perpendicular to the plane in which the pivotal and lower arms 26, 28 are mutually slidably movable relative to each other. This arrangement enables the internal thread of the internally threaded member 44 to be held in coaxial relationship with the feedscrew 42 even when the guide piece 36 is rotated about its axis as a result of movement of the lower arm 28 relative to the pivotal arm 26 in the above-indicated plane. A cylindrical portion of each guide piece 36, 38 which engages the corresponding elongate hole 32, 34 has a diameter substantially equal to the width dimension of the elongate hole 32, 34. This dimensional relationship permits smooth movements of the guide pieces 36, 38 through the elongate holes 32, 34 in the longitudinal direction of the latter while preventing movements of the guide pieces 36, 38 relative to the pivotal arm 26 in the transverse direction of the elongate holes 32, 34, even while the lower arm 28 is moved relative to the pivotal arm 26. Where the guide pieces 36, 38 are disposed on the lower arm 28 such that the guide pieces 36, 38 are rotatable relative to the lower arm 28 about respective axes perpendicular to the above-indicated plane, portions of the guide pieces 36, 38 which engage the respective elongate holes 32, 34 may have polygonal shapes in transverse cross section and a width substantially equal to the width dimension of the elongate holes 32, 34. In this case, the guide piece 36 may be formed integrally with the internally threaded member 44. The thread pitch of the feedscrew 42 and the speed reduction ratio of the rotary drive device 46 are determined so as to prevent a rotary movement of the feedscrew 42 and a consequent movement of the lower arm 28 due to a load applied from the internally threaded member 44 to the feedscrew 42 when the pedal arm 16 is operated at the pedal pad 18, or due to a vibration of the brake pedal device 10 during running of the vehicle. When the switch for operating the rotary drive device 46 is turned off, the rotary and axial movements of the feedscrew 42 are terminated, so that the lower arm 28 is positioned relative to the pivotal arm 26. Thus, the relative-movement device 40 serves as a positioning device for positioning the pivotal and lower arms 26, 28 relative to each other.

In the present brake pedal device 10, the lower arm 28 is connected to the pivotal arm 26 through mutual engagement of the pair of straight elongate holes 32, 34 and the pair of guide pieces 36, 38, such that the pivotal and lower arms 26, 28 are movable relative to each other in the above-indicated plane by an operation of the relative-movement device 40, so that the pedal pad 18 provided at the lower end of the lower arm 28 is movable in the longitudinal direction of the vehicle. Further, the arrangement of the elongate holes 32, 34 such that the extension lines EXT1 and EXT2 of these elongate holes 32, 34 intersect each other permits a change of the attitude of the pedal pad 18 as the pedal pad 18 is moved in the longitudinal direction so that the pedal arm 16 can be operated with a high degree of operational ease, at the suitably inclined operating surface 18*f* of the pedal pad 18, irrespective of the position of the pedal pad 18 in the longitudinal direction Described more specifically, the level or vertical position of the pedal pad 18 is lowered as the pedal pad 18 is moved in the rearward direction of the vehicle toward the operator's seat. That is, the position of the pedal pad 18 is adjusted depending upon the particular physical characteristics of the operator, so that the height or vertical position of the pedal pad 18 is adjusted to suit the particular length of the pedal operating leg of the operator, for facilitating the manipulation of the pedal arm 16. There is a general tendency that the pedal pad 18 of the pedal arm 16 in its non-operated state is positioned comparatively near the operator's seat where the operator has relatively short legs and feet, and comparatively distant from the operator's seat where the operator has relatively long legs and feet. In view of this tendency, the vertical position of the pedal pad 18 is lowered as the pedal pad 18 is moved in the rearward direction, so that the pedal pad 18 can be relatively easily operated by any operators who are either tall or short.

Further, the present embodiment is adapted such that the operating surface 18*f* of the pedal pad 18 is gradually inclined upwards as the pad 18 is moved toward in the rearward direction toward the operator' seat, so that the pedal pad 18 can be easily operated, irrespective of the position of the pedal pad 18 in the longitudinal direction of the vehicle, which is adjusted depending upon the physical characteristics of the operator. Namely, the operator's foot generator approaches the pedal pad 18 in an almost vertical direction, to press down the pedal pad 18 on its operating surface 18*f*, when the pedal pad 18 is located relatively near the operator's seat. The ease of operation of the pedal arm 16 at the pedal pad 18 can be considerably improved by this arrangement of inclining the operating surface 18*f* upwards as the pedal pad 18 is moved in the rearward direction, together with the arrangement of lowering the level of the operating surface 18*f* as the pedal pad 18 is moved in the rearward direction, depending upon the particular physical characteristics of the operator.

It is also noted that the attitude of the pedal pad 18 can be changed with a change in the longitudinal position of the pedal pad, by a simple mechanism which has the pair of straight elongate holes 32, 34 whose extension lines EXT1 and EXT2 intersect each other, and the pair of guide pieces 36, 38 engaging the elongate holes 32, 34. The straight elongate holes 32, 34 and the guide pieces 36, 38 can be easily formed or manufactured. Accordingly, the present brake pedal device 10 is simpler in construction and available at a lower cost of manufacturer, than the known brake pedal device using an arcuate hole and an arcuate rack In addition, the elongate holes 32, 34 can be formed in the pivotal arm 26 at desired positions, so as to reduce the size of the brake pedal device 10, while assuring a required degree of strength at the connection of the pivotal and lower arms 26, 28.

Further, the required size of the lower arm 28 which is moved relative to the pivotal arm 26 when the position of the pedal pad 18 is adjusted can be made smaller in the present arrangement wherein the guide pieces 36, 38 are disposed on the lower arm 28, than in an arrangement wherein the elongate holes 32, 34 are formed in the lower arm 28. Accordingly, the required space for installation of the brake pedal device 10 on the vehicle can be reduced.

In addition, the position of the pedal pad 18 of the pedal arm 16 in its non-operated state can be easily and rapidly adjusted in the longitudinal direction of the vehicle, owing to a unique arrangement of the relative-movement device 40 which includes the feedscrew 42 disposed on the pivotal arm 26 in parallel to the elongate hole 32, the internally threaded member 44 connected to the guide piece 36 engaging the elongate hole 32, and the electrically operated rotary drive device 46 operatively connected to the feedscrew 42 such that a rotary movement of the feedscrew 42 causes a linear movement of the guide piece 36 and a consequent movement of the lower arm 28 relative to the pivotal arm 26, and such that the termination of the rotary movement of the feedscrew 42 results in the positioning of the lower arm 28 relative to the pivotal arm 26, and the consequent adjustment of the position of the pedal pad 18. In particular, the electrically operated rotary drive device 46 can be easily turned on and off by the operator's controlled switch to initiate and terminate the rotary movement of the feedscrew 42, so that the position of the pedal pad 18 in the longitudinal direction of the vehicle can be adjusted with utmost ease.

Furthermore, the relative-movement device 40 wherein the feedscrew 42 is supported by the pivotal arm 26 such that the feedscrew 42 is not axially movable relative to the pivotal arm 26 is simple in construction and is available at a relatively low cost.

It is further noted that the support shaft 20 about which the pedal arm 16 is pivoted at the pivotal arm 26 is supported by the bracket 14 fixed to the vehicle body 12. This structure to pivotally support the pedal arm 16 has a high mechanical strength, assuring a high degree of durability of the brake pedal device 10 even where this device 10 is subjected to a relatively large operating force at the pedal pad 18.

Figure 3:
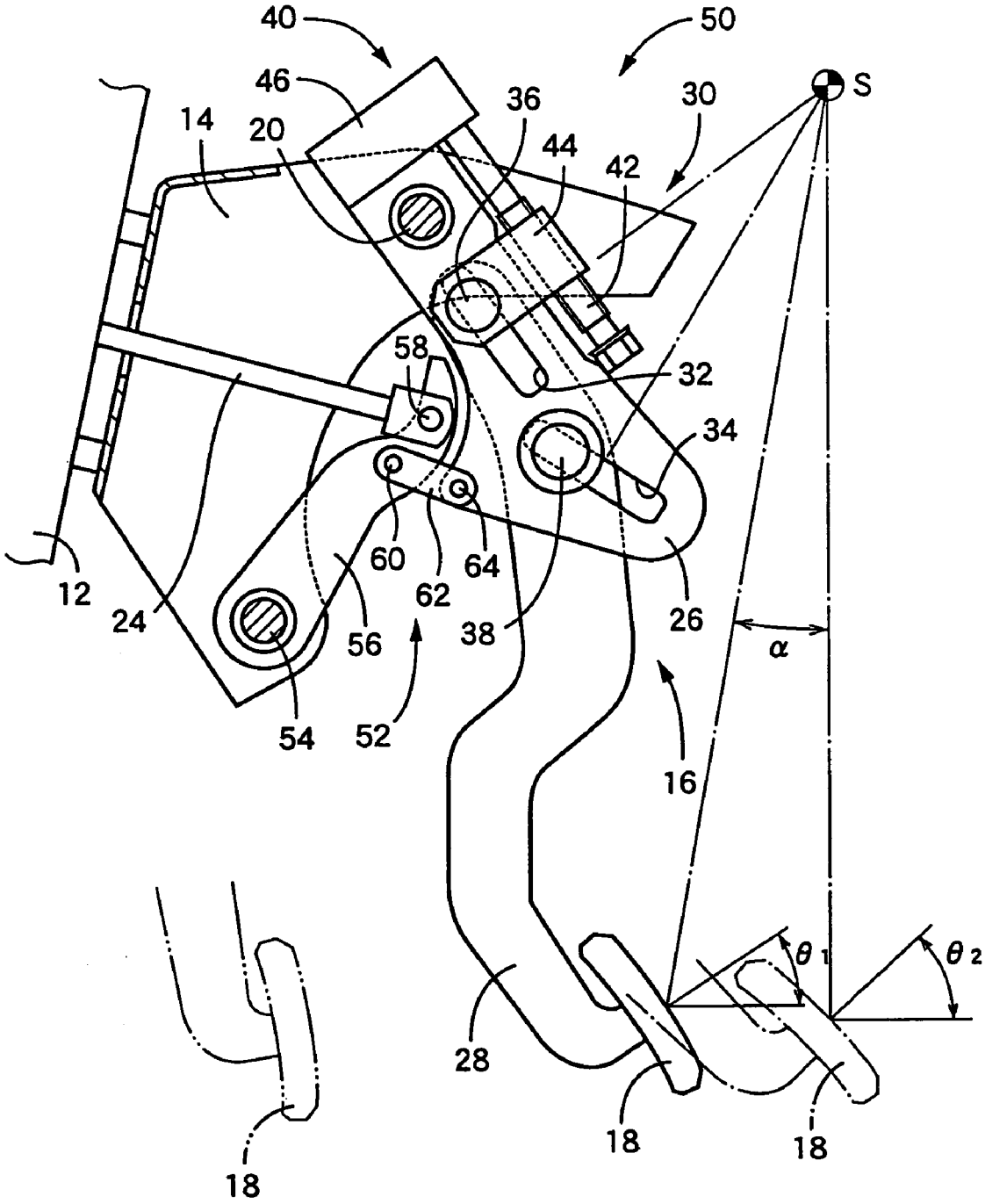
FIG. 3 is a view showing a brake pedal device according to a second embodiment of the invention, which is different from the embodiment of FIG. 1 in that the second embodiment includes a lever-ratio changing mechanism.
Figure 4:
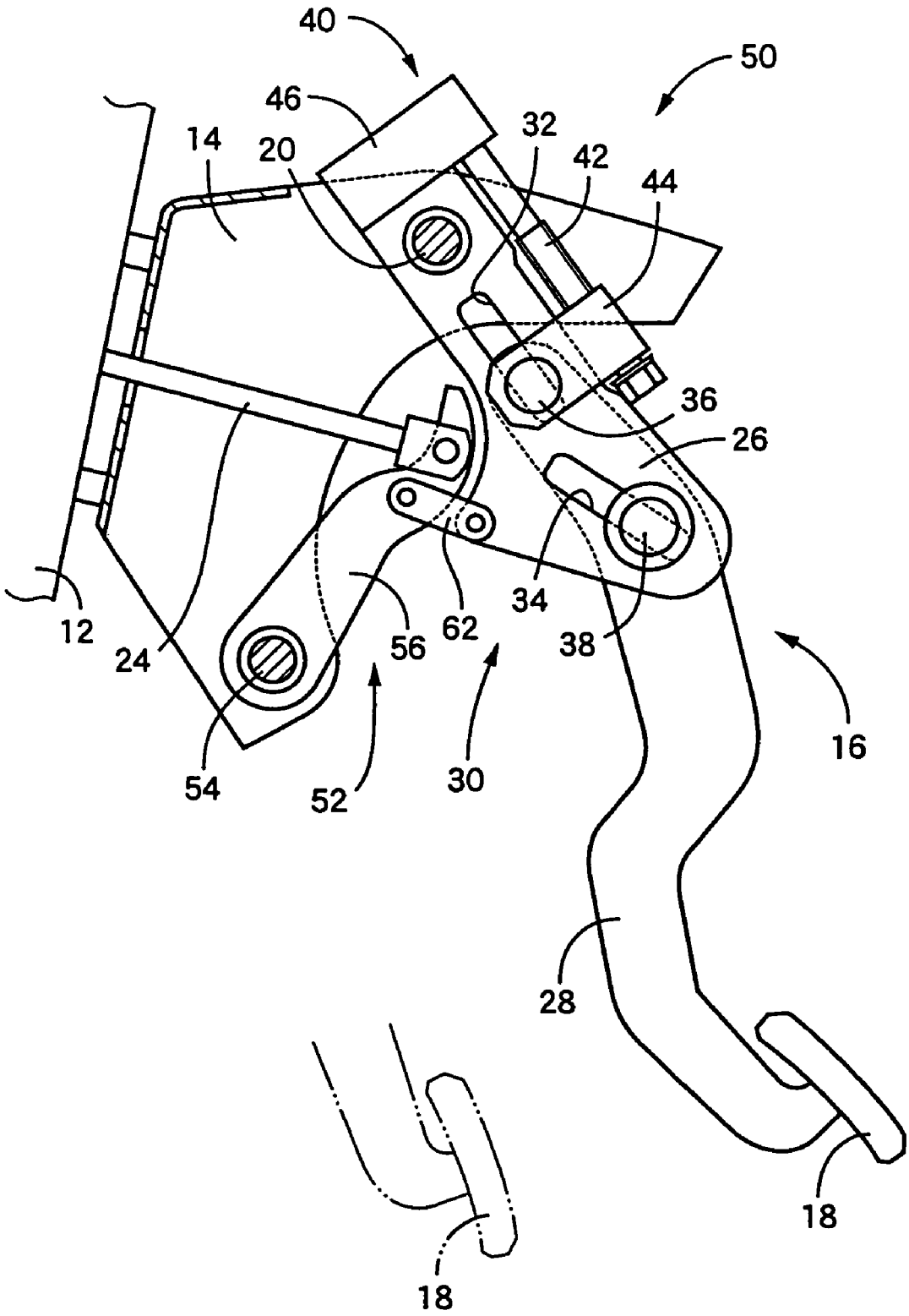
FIG. 4 is a view showing the brake pedal device of FIG. 3 when its pedal operating portion in the non-operated state is located at the fully retracted position.
Figure 5:
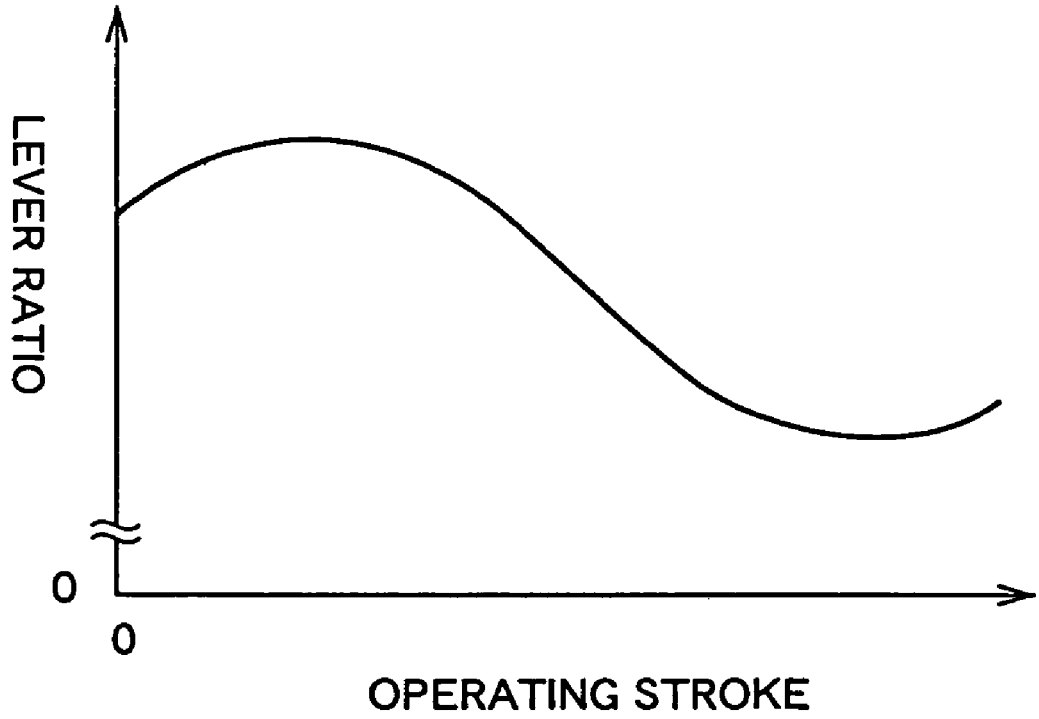
FIG. 5 is a graph indicating an example of a pedal ratio characteristic of the brake pedal device of FIG. 3.

Referring next to FIGS. 3–5, there will be described a second embodiment of this invention. In this embodiment, the same reference signs as used in the first embodiment will be used to identify the functionally corresponding elements, and redundant description of these elements will not be provided.

Figure 2:
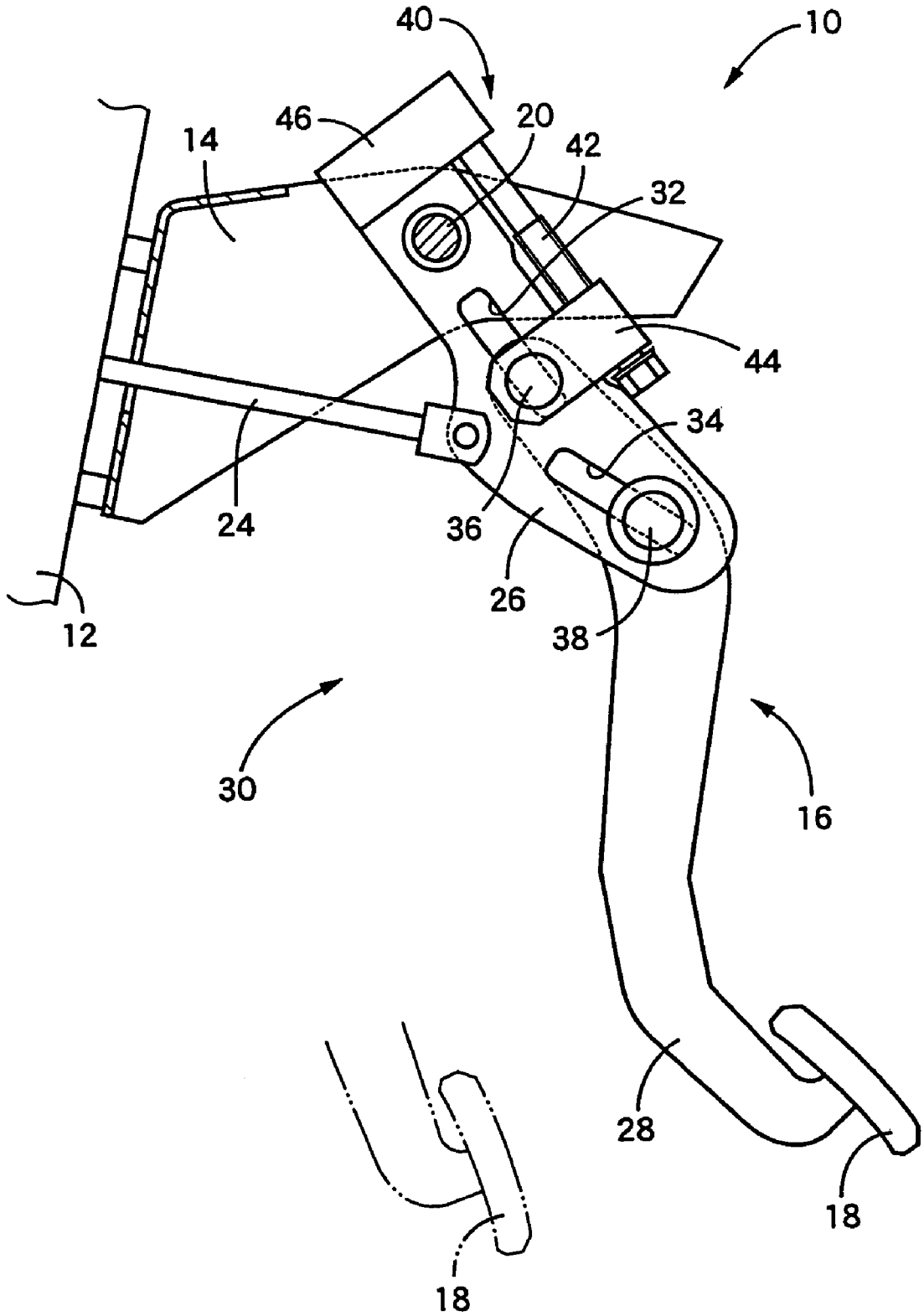
FIG. 2 is a view showing the brake pedal device of FIG. 1 when the pedal operating portion in the non-operated state is located at the fully retracted position.

In FIGS. 3 and 4 corresponding to FIGS. 1 and 2, respectively, there is shown a brake pedal device 50 for an automotive vehicle, which is different from the brake pedal device 10 of the first embodiment in that a lever-ratio changing mechanism 52 is provided between the pivotal arm 26 and the booster rod 24 in the present brake pedal device 50. The lever-ratio changing mechanism 52 includes a lever member 56 which is connected to the bracket 14 through a mounting shaft 54 such that the lever member 56 is pivotable about an axis of the mounting shaft 54 that is parallel to the support shaft 20. To this lever member 56, there is connected the booster rod 24 through a connecting shaft 58 such that the booster rod 24 is pivotable relative to the lever member 56 about an axis of the connecting shaft 58 parallel to the mounting shaft 54. To the lever member 56, there is also connected one end of a connecting link 62 through a connecting shaft 60 such that the connecting link 62 is pivotable relative to the lever member 56 about an axis of the connecting shaft 60 that is also parallel to the mounting shaft 54. The connecting shaft 60 is located nearer to the connecting shaft 58 than to the mounting shaft 54. The connecting link 62 is connected at the other end to the pivotal arm 26 through a connecting shaft 64 such that the connecting link 62 is pivotable relative to the pivotal arm 26 about an axis of the connecting shaft 64 parallel to the connecting shaft 60. The connecting shafts 58, 60, 64 serve as a first, a second and a third connecting shaft, respectively.

In the present brake pedal device 50, which is also arranged to permit an adjustment of the position of the pedal pad 18 of the pedal arm 16 in the non-operated state in the longitudinal direction of the vehicle, the connecting link 62 and the lever member 56 are interconnected between the pivotal arm 26 and the booster rod 24, an operating force acting on the pedal pad 18 is transmitted to the rod 24 through the pivotal arm 26, the connecting link 62 and the lever member 56 in this order of description. According to this arrangement, the lever ratio of the brake pedal device 50 can be easily changed with an increase in the operating stroke of the pedal arm 16 in a desired pattern. This pattern, namely, a relationship between the lever ratio and the operating stroke of the pedal arm 16 can be set or determined depending upon the attitude of the lever member 56 and the positions of connection of the lever member 56 to the rod 24 and the pivotal arm 26, that is, depending upon the configuration of the lever member 56 and the positions of the mounting shaft 54 and the connecting shafts 58, 60. The present arrangement provides a relatively high degree of freedom in the setting of the above-indicated relationship between the brake operating stroke and the lever ratio. The lever-ratio changing mechanism 52 cooperates with the position adjusting device 30 (provided to adjust the position of the pedal pad 18) to provide a significant improvement in the maneuverability of the brake pedal device 50.

The lever ratio indicated above is a ratio at which the operating force acting on the pedal pad 18 is boosted into a force by which the booster rod 24 is pressed, or a ratio of the operating stroke of the pedal pad 18 to that of the rod 24. The graph of FIG. 5 indicates an example of the pattern of change of the lever ratio with a change in the operating stroke of the pedal pad 18 when the pedal arm 16 is pivoted about the support shaft 20. In this example, the lever ratio is relatively low when the operating stroke of the pedal pad 18 is relatively large, so that an amount of operation of the pedal pad 18 required to move the rod 24 by a given distance is relatively small when the operating stroke of the pedal pad 18 is relatively large. It is noted that the distance between the support shaft 20 and the pedal pad 18 is changed as the position of the pedal pad 18 in the non-operated state in the longitudinal direction of the vehicle is changed, so that the pattern of change of the lever ratio with the operating stroke of the pedal pad 18 changes as the position of the pedal pad 18 is changed. Suppose the lever ratio is changed with the operating stroke of the pedal pad 18 as shown in the graph of FIG. 5 where the pedal arm 16 in its non-operated state is placed at the fully advanced position indicated by solid line in FIG. 3, the lever ratio is increased over the entire range of the operating stroke, as compared with the lever ratio shown in FIG. 5, when the pedal arm 16 in its non-operated state is placed at the fully retracted or rearmost position indicated by one-dot chain line in FIG. 3.

Referring to the front elevational views of FIGS. 6 and 7, there is shown a pedal device for an automotive vehicle, in the form of an accelerator pedal device 70 constructed according to a third embodiment of this invention. In FIGS. 6 and 7, the left portion of the views corresponds to the front side of the vehicle, while the right side portion corresponds to the rear side of the vehicle. Namely, the vehicle operator's seat is located on the right side of the views of FIGS. 6 and 7. The accelerator pedal device 70 is mounted on a bracket 74 fixed on a body or frame 72 of the vehicle, and includes a pedal arm 76 having an operating portion in the form of a pedal pad 78 at its lower end. When the pedal arm 76 is depressed at its pedal pad 78 while the pedal arm 76 is placed at its non-operated or original position indicated by solid line in FIG. 6, the pedal arm 76 is pivoted about a support shaft 82 supported by an adjusting plate 80. An amount of pivotal movement of the pedal arm 76 or an amount of operation of the pedal pad 78 is electrically detected by a rotary position sensor 84 disposed on the adjusting plate 80. The support shaft 82 is disposed on the adjusting plate 80 such that the axis of the support shaft 82 extends substantially horizontally, and is substantially parallel to the transverse or lateral direction of the vehicle. While the pedal arm 76 is in the non-operated state, the pedal arm 76 is biased by a return spring (not shown) in the counterclockwise direction about the support shaft 82 as seen in FIG. 6, so that the pedal arm 76 is held at the non-operated position, in abutting contact with a stop 86 provided on the adjusting plate 80.

The bracket 74 and the adjusting plate 80 are substantially planar members in the form of suitably shaped plates having a relatively small thickness. These bracket 74 and adjusting plate 80 are held in surface contact with each other such that they are mutually slidably movable relative to each other in a substantially vertical plane substantially parallel to the longitudinal or running direction of the vehicle. The position of the adjusting plate 80 relative to the stationary bracket 74 when the pedal arm 76 is placed at its non-operated position can be changed, so that the position of the pad 78 can be moved or adjusted in the longitudinal direction of the vehicle. It will be understood that the bracket 74 and the adjusting plate 80 cooperate with a relative-movement device 100 (which will be described) to constitute a major portion of a position adjusting device 90 for adjusting or moving the position of the pad 78 of the pedal arm 76 in the non-operated state, in the longitudinal direction of the vehicle, between a fully advanced position (remotest from the operator's seat) indicated by solid line in FIG. 6 and a fully retracted or rearmost position (nearest to the operator's seat) indicated by solid line in FIG. 7. In FIG. 6, the pad 78 at the fully retracted position is indicated by one-dot chain line, for easy comparison of the position and attitude at the fully retracted position with those at the fully advanced position indicated by the solid line. The operated position of the pedal arm 76 (of the pad 78) is indicated by two-dot chain lines in FIGS. 6 and 7.

The bracket 74 has a pair of straight guides in the form of a pair of straight elongate holes 92, 94 formed therethrough, while the adjusting plate 80 has a pair of guide pieces 96, 98 fixedly provided thereon so as to be linearly movable in engagement with the respective elongate holes 92, 94. The position adjusting device 90 indicated above includes these elongate holes 92, 94 and guide pieces 96, 98, as well as the relative-movement device 100 indicated above. The relative-movement device 100 is arranged to linearly move the guide piece 96 in the longitudinal direction of the elongate hole 92, while being guided by the elongate hole 92, so that at the same time the other guide piece 98 is linearly moved while being guided by the other elongate hole 94, whereby the adjusting plate 80 is moved relative to the bracket 74, so as to move the pedal pad 78 in the longitudinal direction of the vehicle. The two straight elongate holes 92, 94 are positioned and oriented such that extension lines of the elongate holes 92, 94 in their longitudinal direction intersect each other, and so that the position of the pad 78 is gradually lowered while an operating surface 78*f* of the pad 78 is gradually inclined upwards (rotated in the counterclockwise direction as seen in FIG. 6) as the pad 78 is moved toward the fully retracted or rearmost position (indicated by the one-dot chain line in FIG. 6). As in the first and second embodiments, each of the pedal arm 76 and the adjusting plate 80 has two different attitudes corresponding to the fully advanced and retracted positions, which two different attitudes would be taken if the pedal arm 76 were pivoted with the pad 78, about a point of intersection of two straight lines which pass the midpoints of the lengths of the respective elongate holes 92, 94 and which are perpendicular to the longitudinal direction of the elongate holes 92, 94. It will be understood that the bracket 74 serves as a first member of the position adjusting device 90, while the pedal arm 76 and the adjusting plate 80 serve as a second member of the position adjusting device 90.

The relative-movement device 100 includes a feedscrew 102, an internally threaded member 104, and an electrically operated rotary drive device 106. The feedscrew 102 is disposed on the bracket 74 such that the feedscrew 102 extends in parallel with the elongate hole 92 and is ratable about its axis. The internally threaded member 104 is connected to the guide piece 96 engaging the elongate hole 92, and is held in meshing engagement with the feedscrew 102. The rotary drive device 106 includes an electric motor and gears operatively connected to the feedscrew 102. The electric motor is operated to rotate the feedscrew 102 in a selected one of the opposite directions, upon operation of a suitable switch by the vehicle operator. The internally threaded member 104 is connected to the guide piece 96 such that the member 104 is pivotable about an axis of the guide piece 96 which is perpendicular to the plane in which the bracket 74 and adjusting plate 80 are mutually slidably movable relative to each other. This arrangement enables the internal thread of the internally threaded member 104 to be held in coaxial relationship with the feedscrew 102 even when the guide piece 96 is rotated about its axis as a result of movement of the adjusting plate 80 relative to the bracket 74 in the above-indicated plane. A cylindrical portion of each guide piece 96, 98 which engages the corresponding elongate hole 92, 94 has a diameter substantially equal to the width dimension of the elongate hole 92, 94. This dimensional relationship permits smooth movements of the guide pieces 96, 98 through the elongate holes 92, 94 in the longitudinal direction of the latter while preventing movements of the guide pieces 96, 98 relative to the bracket 74 in the transverse direction of the elongate holes 92, 94, even while the adjusting plate 80 is moved relative to the bracket 74. Where the guide pieces 96, 98 are disposed on the adjusting plate 80 such that the guide pieces 96, 98 are rotatable relative to the adjusting plate 80 about respective axes perpendicular to the above-indicated plane, portions of the guide pieces 96, 98 which engage the respective elongate holes 92, 94 may have polygonal shapes in transverse cross section and a width substantially equal to the width dimension of the elongate holes 92, 94. In this case, the guide piece 96 may be formed integrally with the internally threaded member 104. The thread pitch of the feedscrew 102 and the speed reduction ratio of the rotary drive device 106 are determined so as to prevent a rotary movement of the feedscrew 102 and a consequent movement of the adjusting plate 80 due to a load applied from the internally threaded member 104 to the feedscrew 102 when the pedal arm 76 is operated at the pedal pad 78, or due to a vibration of the accelerator pedal device 70 during running of the vehicle. When the switch for operating the rotary drive device 106 is turned off, the rotary and axial movements of the feedscrew 102 are terminated, so that the adjusting plate 80 is positioned relative to the bracket 74. Thus, the relative-movement device 100 serves as a positioning device for positioning the bracket 74 and adjusting plate 80 relative to each other.

In the present accelerator pedal device 70, the adjusting plate 80 is connected to the bracket 74 through mutual engagement of the pair of straight elongate holes 92, 94 and the pair of guide pieces 96, 98, such that the adjusting plate 80 and bracket 74 are movable relative to each other in the above-indicated plane by an operation of the relative-movement device 100, so that the pedal pad 78 provided at the lower end of the pedal arm 76 is movable in the longitudinal direction of the vehicle. Further, the arrangement of the elongate holes 92, 94 such that the extension lines of these elongate holes 92, 94 intersect each other permits a change of the attitude of the pedal pad 78 as the pedal pad 78 is moved in the longitudinal direction so that the pedal arm 78 can be operated with a high degree of operational ease, at the suitably inclined operating surface 78*f* of the pedal pad 78, irrespective of the position of the pedal pad 78 in the longitudinal direction.

As in the first and second embodiments, the level or vertical position of the pedal pad 18 is lowered and the operating surface 78*f* is gradually inclined upwards as the pedal pad 78 is moved in the rearward direction of the vehicle toward the operator's seat. That is, the vertical position of the pedal pad 78 and the inclination of the operating surface 78*f* are adjusted to suit the particular physical characteristics of the operator, for facilitating the manipulation of the pedal arm 78.

It is also noted that the attitude of the pedal pad 78 can be changed with a change in the longitudinal position of the pedal pad, by a simple mechanism which has the pair of straight elongate holes 92, 94 intersecting each other and the pair of guide pieces 96, 98 engaging the elongate holes 92, 94. The straight elongate holes 92, 94 and the guide pieces 96, 98 can be easily formed or manufactured. Accordingly, the present accelerator pedal device 70 is simpler in construction and available at a lower cost of manufacture, than the known accelerator pedal device using an arcuate hole and an arcuate rack. In addition, the elongate holes 92, 94 can be formed in the bracket at desired positions, so as to reduce the size of the accelerator pedal device 70, while assuring a required degree of strength at the connection of the bracket 74 and adjusting plate 80.

Further, the required size of the pedal arm 76 which is moved relative to the bracket 74 when the position of the pedal pad 78 is adjusted can be made smaller in the present arrangement wherein the guide pieces 96, 98 are disposed on the pedal arm 76, than in an arrangement wherein the elongate holes 92, 94 are formed in the pedal arm 76. Accordingly, the required space for installation of the accelerator pedal device 70 on the vehicle can be reduced.

In addition, the position of the pedal pad 78 of the pedal arm 76 in its non-operated state can be easily and rapidly adjusted in the longitudinal direction of the vehicle, owing to a unique arrangement of the relative-movement device 100 which includes the feedscrew 102 disposed on the bracket 74 in parallel to the elongate hole 92, the internally threaded member 104 connected to the guide piece 96 engaging the elongate hole 92, and the electrically operated rotary drive device 106 operatively connected to the feedscrew 102 such that a rotary movement of the feedscrew 102 causes a linear movement of the guide piece 96 and a consequent movement of the pedal arm 76 relative to the bracket 74, and such that the termination of the rotary movement of the feedscrew 102 results in the positioning of the pedal arm 76 relative to the bracket 74, and the consequent adjustment of the position of the pedal pad 78. In particular, the electrically operated rotary drive device 106 can be easily turned on and off by the operator's controlled switch to initiate and terminate the rotary movement of the feedscrew 102, so that the position of the pedal pad 78 in the longitudinal direction of the vehicle can be adjusted with utmost ease.

Furthermore, the relative-movement device 100 wherein the feedscrew 102 is supported by the bracket 74 such that the feedscrew 102 is not axially movable relative to the bracket 74 is simple in construction and is available at a relatively low cost.

It is further noted that the operating amount of the pedal arm 76 at the pedal pad 78 is converted into an electric signal by the sensor 84, so that the accelerator pedal device 70 is made simpler in construction than an accelerator pedal device in which the pedal arm whose non-operated position is adjustable in the longitudinal direction of the vehicle is mechanically connected to a motion transmitting member in the form of an accelerator cable.

While the presently preferred embodiments of this invention have been described in detail by reference to the drawings, for illustrative purpose only, it is to be understood that the present invention may be embodied with various other changes, modifications and improvements, which may occur to those skilled in the art, in the light of the technical teachings of the present invention which have been described.

What is claimed is:

1. A pedal device mounted on a bracket fixed to a body of an automotive vehicle, and including a pedal arm having an operating portion at a lower end thereof and being pivotal about a support shaft in accordance with a depressing operation thereof, and a position adjusting device operable to adjust a position of said operating portion in a longitudinal direction of the automotive vehicle where said pedal arm is placed in a non-operated state thereof, said pedal device comprising:

a first member having a guide;

a second member disposed movably relative to said first member in said longitudinal direction, and having a guide piece which is movable in engagement with said guide, respectively; and a positioning device operable to establish a desired relative position between said first and second members, by moving said guide and said guide piece relative to each other, said positioning device permitting said first and second members to maintain said desired relative position after said desired relative position is established, wherein one of said first and second members has said operating portion and is movable relative to the other of said first and second members, to move said operating portion in said longitudinal direction, and wherein said other of said first and second members is operatively connected to a power transmitting member such that an operating force acting on said operating portion of said pedal arm is transmitted to said power transmitting member, said pedal device further including a lever-ratio changing mechanism interconnected between said other of said first and second members and said power transmitting member, said lever-ratio changing mechanism being operable to change a lever ratio of said pedal device with a change in an operating stroke of said operating portion of said pedal arm, and wherein said lever-ratio changing mechanism indicates a non-linear pattern of change of the lever ratio with the change in the operating stroke of said operation portion while said pedal arm is pivoted about the support shaft.

2. The pedal device according to claim 1, wherein said bracket has a mounting shaft perpendicular to approximately vertical plane approximately parallel to said longitudinal direction, and said lever-ratio changing mechanism includes a lever member disposed on said bracket pivotally about said mounting shaft and connected to said power transmitting member pivotally about a first connecting shaft parallel to said mounting shaft, and a connecting link connected at one of opposite ends to said lever member pivotally about a second connecting shaft parallel to said mounting shaft, and at the other end to said other of said first and second members pivotally about a third connecting shaft parallel to said second connecting shaft, wherein said operating force is transmitted from said pedal arm to said power transmitting member through said other of said first and second members, said connecting link and said lever member.

3. The pedal device according to claim 1, wherein said guide is formed and positioned such that an attitude of said operating portion changes as said operating portion is moved in said longitudinal direction.

4. The pedal device according to claim 1, wherein said guide is formed and positioned such that a vertical position of said operating portion changes as said operating portion is moved in said longitudinal direction.

5. The pedal device according to claim 1, wherein said first member has a pair of guides and said second member has a pair of guide pieces, and wherein said pair of guides consist of a pair of straight guides which are positioned such that extension lines of said straight guides intersect each other such that an attitude of said operating portion changes as said operating portion is moved in said longitudinal direction as a result of a relative movement of said first and second members with said pair of guide pieces being moved in engagement with said pair of straight guides, respectively.

6. The pedal device according to claim 5, wherein said pair of straight guides are positioned such that the vertical position of said operating portion is lowered while an operating surface of said operating portion is gradually inclined upwards as said operating portion is moved in a rearward direction of the vehicle parallel to said longitudinal direction.

7. The pedal device according to claim 5, wherein said second member has said operating portion and is movable relative to said first member, and said positioning device comprises a relative-movement device including a feedscrew disposed on said first member such that said feedscrew is parallel to one of said pair of straight guides and rotatable about an axis thereof, and an internally threaded member connected to one of said guide pieces which engages said one of said pair of straight guides, said internally threaded member being held in engagement with said feedscrew and pivotable relative to said second member about an axis perpendicular to an approximately vertical plane approximately parallel to said longitudinal direction, and wherein said relative-movement device is operable to rotate said feedscrew to move said second member relative to said first member and maintain said desired relative position between said first and second members after a rotary motion of said feedscrew is terminated.

8. The pedal device according to claim 1, wherein said pedal arm includes said one of said first and second members, and said other of said first and second members which does not have said operating portion is a pivotal arm which is disposed pivotally about a support shaft supported by said bracket, said pedal arm being pivoted about said support shaft when said pedal arm is operated at said operating portion.

9. A pedal device mounted on a bracket fixed to a body of an automotive vehicle, and including a pedal arm having an operating portion at a lower end thereof, and a position adjusting device operable to adjust a position of said operating portion in a longitudinal direction of the automotive vehicle where said pedal arm is placed in a non-operated state thereof, said pedal device comprising:

a first member having a guide;

a second member disposed movably relative to said first member in said longitudinal direction, and having a guide piece which is movable in engagement with said guide, respectively; and a positioning device operable to establish a desired relative position between said first and second members, by moving said guide and said guide piece relative to each other, said positioning device permitting said first and second members to maintain said desired relative position after said desired relative position is established, wherein one of said first and second members has said operating portion and is movable relative to the other of said first and second members, to move said operating portion in said longitudinal direction, wherein said other of said first and second members is operatively connected to a power transmitting member such that an operating force acting on said operating portion of said pedal arm is transmitted to said power transmitting member, said pedal device further including a lever-ratio changing mechanism interconnected between said other of said first and second members and said power transmitting member, said lever-ratio changing mechanism being operable to change a lever ratio of said pedal device with a change in an operating stroke of said operating portion of said pedal arm, and wherein said bracket has a mounting shaft perpendicular to approximately vertical plane approximately parallel to said longitudinal direction, and said lever-ratio changing mechanism includes a lever member disposed on said bracket pivotally about said mounting shaft and connected to said power transmitting member pivotally about a first connecting shaft parallel to said mounting shaft, and a connecting link connected at one of opposite ends to said lever member pivotally about a second connecting shaft parallel to said mounting shaft, and at the other end to said other of said first and second members pivotally about a third connecting shaft parallel to said second connecting shaft, wherein said operating force is transmitted from said pedal arm to said power transmitting member through said other of said first and second members, said connecting link and said lever member.

* * * * *